United States Patent [19]

Miller

[11] Patent Number: 4,955,104

[45] Date of Patent: Sep. 11, 1990

[54] LIQUID DISPENSING AND SUCTIONING SYSTEM FOR SURFACE CLEANING

[75] Inventor: Jonathan Miller, Tenafly, N.J.

[73] Assignee: Shop-Vac Corporation, Williamsport, Pa.

[21] Appl. No.: 365,479

[22] Filed: Jun. 13, 1989

[51] Int. Cl.[5] ..... A47L 7/00

[52] U.S. Cl. ..... 15/322; 15/321; 15/339

[58] Field of Search ..... 15/321, 322

[56] References Cited

U.S. PATENT DOCUMENTS

| | | | |
|---|---|---|---|
| 3,605,171 | 9/1971 | Candor et al. | 15/322 X |
| 3,711,891 | 1/1973 | Conway | 15/322 X |
| 4,185,354 | 1/1980 | Brazier | 15/321 |
| 4,335,486 | 6/1982 | Kochte | 15/322 X |
| 4,887,330 | 12/1989 | Woodhall et al. | 15/322 |

FOREIGN PATENT DOCUMENTS

| | | | |
|---|---|---|---|
| 2145620 | 4/1985 | United Kingdom | 15/322 |

*Primary Examiner*—Chris K. Moore

*Attorney, Agent, or Firm*—Ostrolenk, Faber, Gerb & Soffen

[57] ABSTRACT

Dispensing within a liquid dispensing and suctioning system is controlled by pinching a flexible tube with a spring-biased actuator. The system includes a slidable extension for pulling the actuator to open the tube to dispense liquid to a surface to be cleaned. The system is assembled with a tubular wand of a wet/dry suctioning system. The liquid dispensing outlet from the system is a slot from which liquid exits. That outlet slot is disposed near to the suction inlet slot of the suctioning system. A rib which is located between the dispensing outlet and the suction inlet contacts the surface being suctioned for assuring that liquid reaches that surface and is not sucked up in the suction nozzle inlet reaching the surface.

11 Claims, 4 Drawing Sheets

LIQUID DISPENSING AND SUCTIONING SYSTEM FOR SURFACE CLEANING

BACKGROUND OF THE INVENTION

The invention relates to a system for cleaning a surface. The system includes means for storing a cleaning liquid, means for dispensing the liquid to the surface to be cleaned and means for suctioning the liquid along with any dirt, and the like, that has been washed from the surface or dissolved in the liquid from the surface.

The prior art includes wet/dry suctioning systems which are adapted to pick up dispensed liquid and wet materials from a surface. Such suctioning systems typically include a collection tank, a take-up hose for transmitting the liquid or the wet materials from the surface to the collection tank and a suction motor, typically communicating with the tank, for generating a vacuum in the hose.

A surface can be cleaned more easily by spreading a cleaning liquid, such as a solution of water and detergent, across the surface. The surface can be a floor, a carpet or other surface. The liquid facilitates cleaning by dissolving and lifting off dirt, and the like, from the surface to be cleaned. Furthermore, the subsequent suctioning helps to dry the surface or carpet by lifting away the liquid and wet material from the surface.

Accordingly, liquid dispensing and suctioning systems have been developed to dispense cleaning liquid to a surface or carpet to be cleaned and to thereafter suction the liquid from the surface after the liquid has dissolved or lifted off dirt, and the like. Some of these liquid dispensing and suctioning systems are entirely self contained. Others are developed as attachments to an intake hose or wand of a standard wet/dry suctioning system. The liquid may be supplied to the attachment from an external source through a hose or tube or the liquid may be carried on the cleaning attachment within a tank.

In some systems, liquid may drip continuously through a nozzle leading from a liquid supply container. However, it is advantageous to selectively control the dispensing of liquid from the liquid dispensing and suctioning systems. Such control may be achieved, for example, by a manually operable trigger for opening a dispensing nozzle or valve. Liquid may be dispensed periodically or continuously.

In a system that is the subject of pending U.S. Application Pat. No. 07/282,103, filed Dec. 9, 1988, there is a common unit that is applied at the carpet or the surface being cleaned and which both delivers the liquid to the carpet or surface and suctions up that liquid. If the liquid dispensing outlet and suction nozzle of that unit are located near each other, liquid dispensed through the outlet is suctioned into the suction nozzle before it is delivered to the carpet or surface. The liquid migrates along the underside of the housing of the nozzle system into the suction inlet without wetting the carpet or other surface and thus without cleaning it. Enlarging the distance between the liquid outlet and the suction nozzle enlarges the surface area of the underside of the nozzle that contacts the carpet or surface. Bringing the entire dispensing outlet to the carpet or surface being cleaned has the same effect. It is desirable to limit or reduce the surface area of the nozzle contacting the carpet.

SUMMARY OF THE INVENTION

Accordingly, it is an object of the invention to provide an improved system for dispensing cleaning liquid to a surface or carpet to be cleaned and for subsequently suctioning the liquid along with dirt and the like from the surface.

It is another object of the invention to provide such a system which avoids suctioning up dispensed liquid before it is delivered to the carpet or surface being cleaned.

It is a further object of the invention to minimize the surface area of the suction nozzle in contact with the carpet or other surface being cleaned, especially when a carpet is being cleaned, so that the nozzle will normally press into the carpet for affording more effective suction pickup.

The invention is directed to a liquid dispensing and suctioning attachment for dispensing liquid to a surface or carpet to be cleaned and for suctioning the liquid along with dirt and the like from the surface. The attachment is connectable through a tube with a source of suction, like a suction motor at a collection tank. The suction tube is included in a hand held tubular wand. There is a suction nozzle at the end of the tube at the wand. The suction nozzle has an inlet positionable adjacent the surface to be cleaned for intake of the liquid, dirt, and the like, and has an outlet fitting attached to an intake end of the wand leading to the collecting container.

The attachment further includes a tank for containing the liquid to be dispensed. The tank is physically located at and is attached to the nozzle at the end of the wand. However, the liquid to be dispensed may be transmitted from a remote liquid supply as well.

The attachment further includes a dispenser for selectively dispensing the liquid to the surface to be cleaned. The dispenser includes an actuator, means for biasing the actuator toward a closed position to retain the liquid in the tank and means for moving the actuator to an open position to dispense the liquid to the surface to be cleaned and a liquid dispensing outlet in the form of a slot extending across the width of the attachment, generally at its underside. Instead of a single slot, the outlet may be defined by a series of liquid outlet openings arranged across the attachment which together effectively define a slot. The suction nozzle inlet is also in the form of a slot extending across the width of the attachment at its underside. The suction inlet is near to and forward of the dispensing outlet, and they extend parallel. The dispensing outlet may be upraised above the suction nozzle inlet at the bottom of the attachment.

The liquid dispensing outlet slot and the suction nozzle are quite near each other, e.g. in a common housing, as at the bottom of the tank. They are so near to each other that when liquid is dispensed from the dispensing outlet, which is typically above the surface being cleaned, the liquid is sucked into the suction nozzle inlet, without wetting or cleaning the carpet or other surface. Bringing the entire dispensing outlet slot, and particularly its periphery, to the carpet or surface when combined with the suction inlet, brings too large a surface area to the carpet.

The invention comprises providing a liquid transmitting surface, located between the dispensing outlet and the inlet to the suction nozzle and positioned to contact the carpet or other surface. This surface provides a conduit or transmission path for the liquid and transmits it to the carpet or surface. The suction inlet on the opposite side of the liquid transmitting surface picks up the liquid from the carpet or other surface. The liquid transmitting surface may be a rib extending across the unit between the dispensing outlet and suction nozzle. The rib is a narrow element front-to-back, and extends straight across the attachment. It is located near enough to the suction nozzle that it does not significantly enlarge the surface area of the attachment which is in contact with the carpet.

Other objects and features of the present invention will become apparent from the following description of a preferred embodiment of the invention considered in conjunction with the accompanying drawings.

DESCRIPTION OF THE PREFERRED EMBODIMENT

Figure 1:
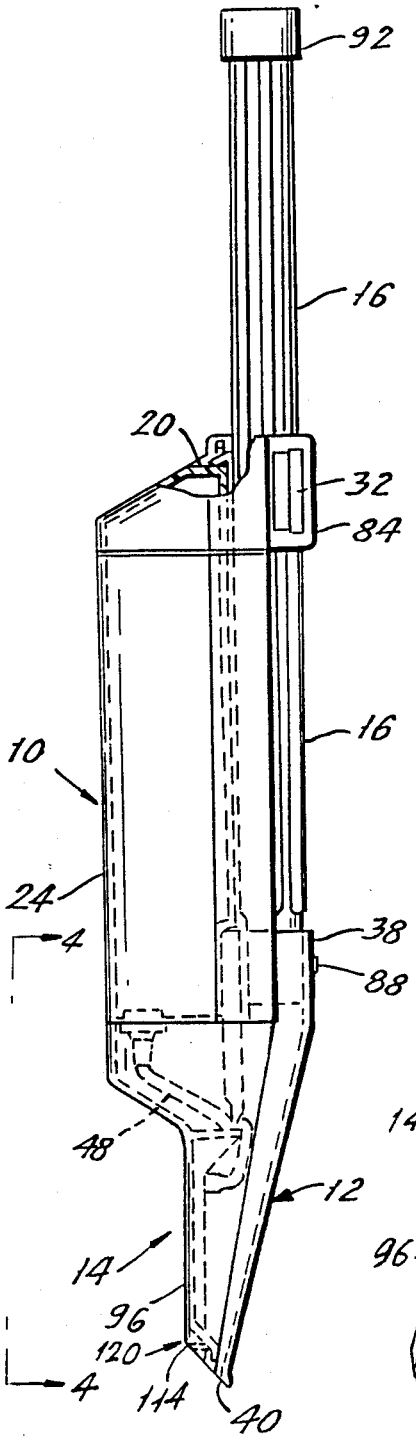
FIG. 1 is a side view of the tank, dispensing system, suction nozzle and lower wand section of a preferred embodiment of the liquid dispensing and suctioning system.
Figure 4:
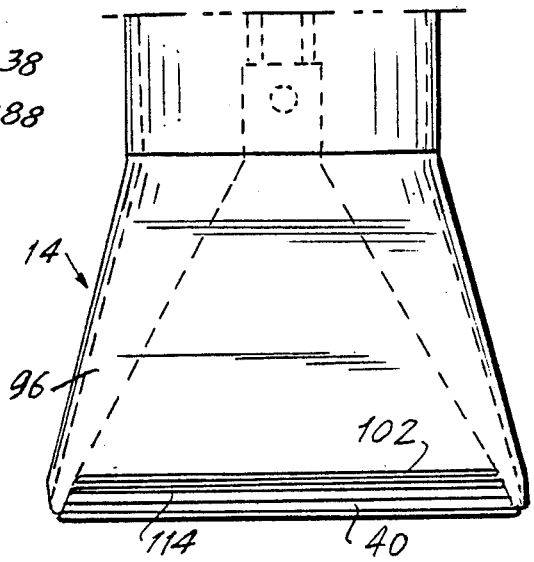
FIG. 4 is a rear view of the attachment.

The preferred embodiment of the invention in FIGS. 1 and 9 includes a tank 10 for containing cleaning liquid (not illustrated) therein, a nozzle 12 for delivering the liquid and a dispensing system 14 for valving the liquid from the tank to the nozzle. The tank 10, the nozzle 12 and the dispensing system 14 are connectable to a tubular wand section 16 which in turn is connectable to an upper, separate tubular wand section 18. In operation, liquid is selectively and controllably dispensed from the tank 10 to a surface to be cleaned (not illustrated) to dissolve or lift off dirt and the like from the surface. Suction is then drawn from a below described suction source 130, through the tube 124, wand sections 16 and 18, and then through the nozzle 12 so that the liquid, along with the dirt and the like, is drawn up through the nozzle 12 and out through the wand sections 16 and 18.

Except as otherwise indicated, the various parts of the preferred embodiment of the system are formed of molded, relatively rigid plastic.

Figure 2:
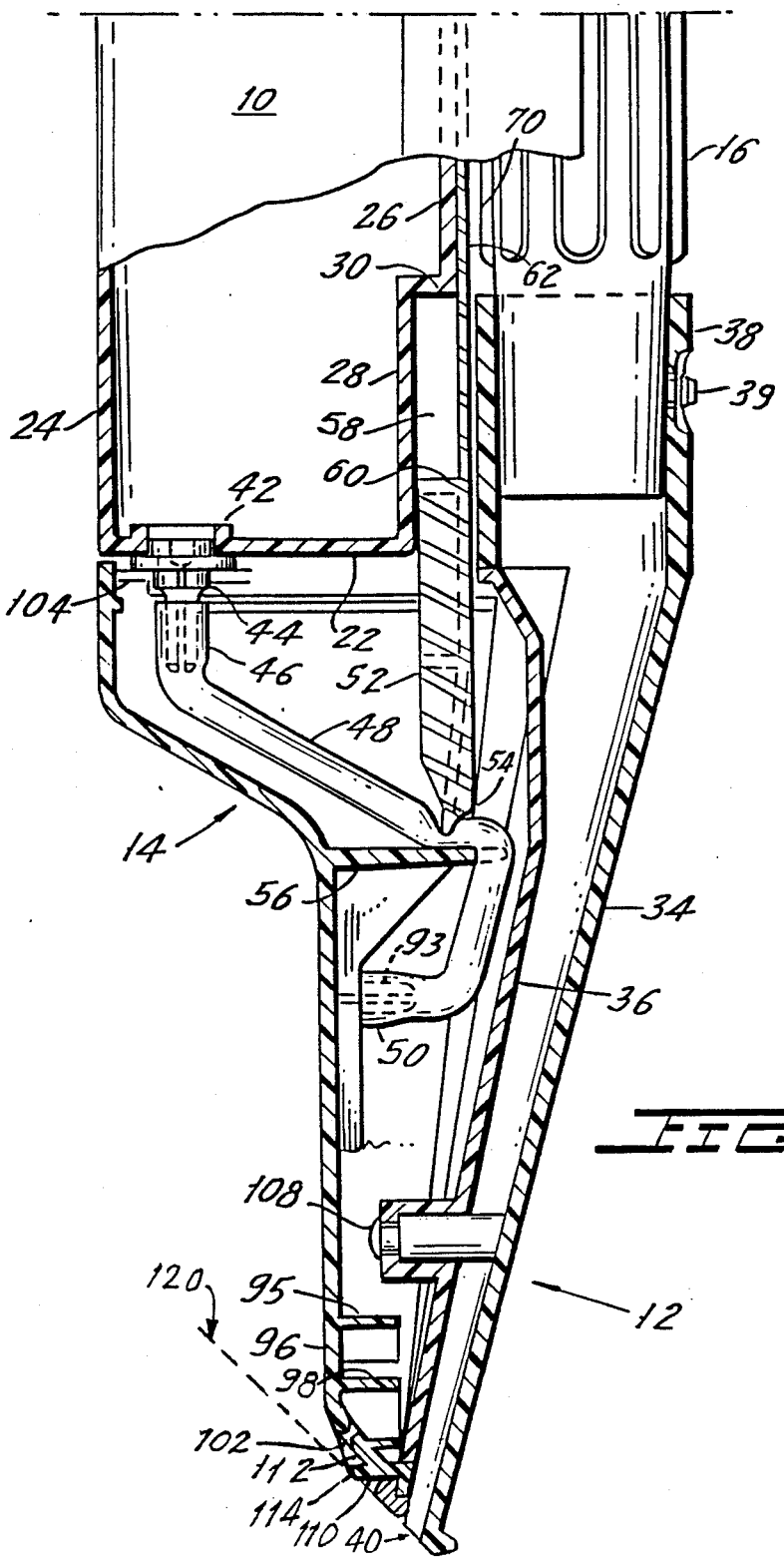
FIG. 2 is a cutaway side view which details the lower portion of the features illustrated in FIG. 1.

Referring to FIGS. 1 and 2, the tank 10 is a total enclosure defined by an upper wall 20 away from the nozzle 12, an opposite lower wall 22 at the bottom of the tank, a back wall 24 which is at the side toward the user and a front wall 26, which has the nozzle 12 and wand section 16 in front of it. The walls 20–26 enclose the tank. A recess 28 is defined in the tank front wall 26 toward the lower wall 22 for receiving and guiding vertical shifting of the below described pinch slide 52. A ledge 30 defines the top of that recess. A filler cap 32 is accessibly placed near the top of the tank, through which the tank 10 may be filled with liquid.

The suction nozzle 12 is preferably molded of clear plastic, permitting observation of the liquid being sucked through the nozzle. The nozzle has a front cover 34 facing the front of the attachment and a rear wall 36 at the front of the waterfall 96. An outlet fitting 38 at the top of the nozzle connects it to the wand section 16. The lower end of the lower wand section 16 is retained in the outlet fitting 38 of the nozzle 12 by means of a spring biased button detent 39. A suction inlet 40 at the bottom of the nozzle 12 is to be placed at the carpet or surface to be suctioned. From its front side 141 to its rear side 142, the suction inlet is narrow all across the nozzle 12, to minimize the cross-section of the nozzle pressed against the carpet, as discussed further below. The cross-section of the nozzle 12 generally narrows in lateral side to side width and increases in front to back height from the suction inlet 40 to the outlet fitting 38.

The liquid dispensing system 14 includes an outlet fitting 42 located at the lower wall 22 of the tank 10. A connecting member 44 is spin-welded to the outlet fitting 42. The inlet end 46 of a flexible, resilient, preferably elastomeric rubber or plastic tube 48 is pushed over and retained on the connecting member 44. The opposite outlet end 50 of the tube 48 is held below the inlet end 46 and is maintained open so that cleaning liquid can flow under the force of gravity from the tank 10 through the connecting member 44, through the flexible tube 48 and then out past the open outlet end 50.

The dispensing system 14 further includes a tube pinch slide 52 which serves as an on-off valve for flow through the tube 48. The slide 52 includes a pinch tip 54 which is movable toward and away from a shelf 56 that is molded in the dispenser wall 96 and the shelf projects beneath the pinch tip 54. The flexible tube 48 passes between the tip 54 and the shelf 56. The slide 52 is biased down toward the shelf 56 by a compression spring 58. The compression spring 58 and a portion of the slide 52 are located within the recess 28 and between the tank 10 and the nozzle 12. The spring 58 is compressed between the ledge 30 of the tank 10 and the rear end 60 of the slide 52. Thus, the slide 52 is biased toward the shelf 56 so as to pinch the flexible tube 48 between the tip 54 and the shelf 56. When the flexible tube 48 is pinched, cleaning liquid cannot flow through the tube and is retained within the tank 10.

A lower extension 62 extends up from the slide 52. The extension 62 is used for pulling the slide 52 away from the shelf 56 to open the tube 48 which permits dispensing of the liquid. The extension 62 is relatively thin front to back and wide laterally so as to slide in front of the tank 10 and to the rear of the nozzle 12. Details of the extension 62 are not provided here. Generally, there are means 70 at the wand section 18 enabling a user to pull on the extension 62 and raise the slide 52. Details of this means 70 are found in the above noted U.S. Application Pat. No. 07/282,103. When the means 70 is pulled upwardly manually, it pulls up the extension 62 which in turn raises the slide 52 away from the nozzle 12 to open the flexible tube 48. When the means 70 is released, the compression spring 58 urges the slide 52 toward the shelf 56 to pinch closed the flexible tube 48.

Figure 3:
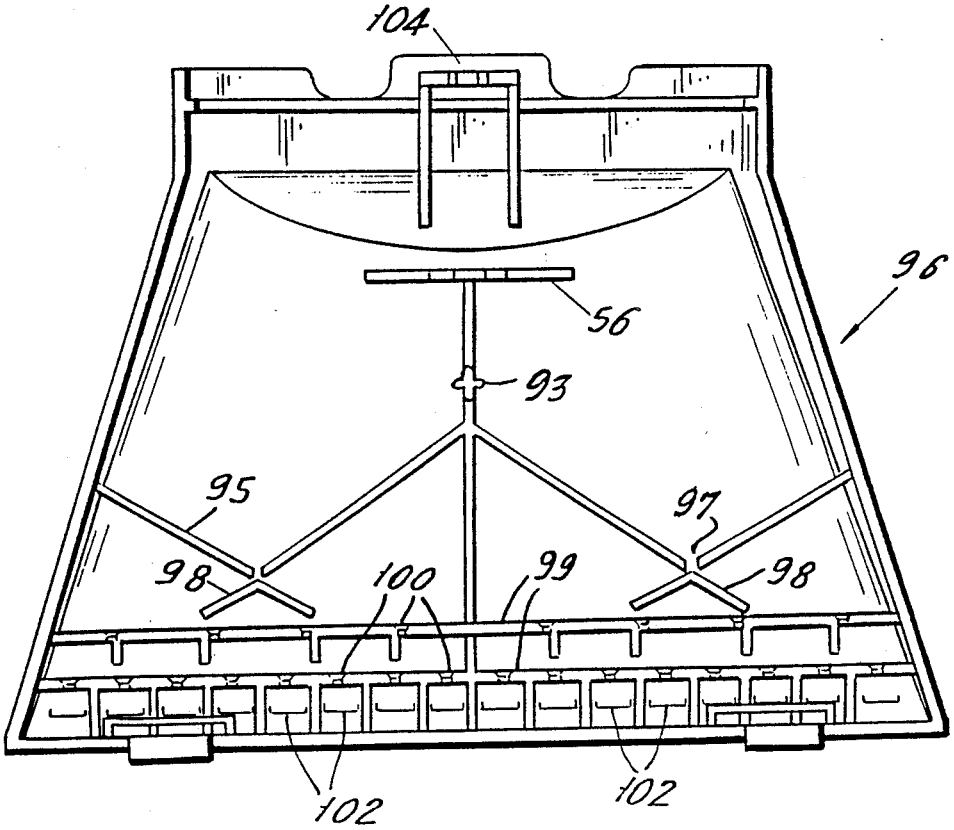
FIG. 3 is a front view of the cascade waterfall used with the preferred embodiment of the attachment.

The lower outlet end 50 of the flexible tube 48 is received on a prong 93 projecting from the front side of a cross-shaped initial flow divider 94. The divider 94 initially dispenses the liquid flow as it exits the tube 48. After the liquid falls off the divider, it cascades and flows across a waterfall arrangement 96 shown in FIG. 3. That arrangement is located to the rear of the nozzle, and the rear wall of the waterfall arrangement is typically inclined downward and forward, so that the liquid runs down the rear wall.

The waterfall arrangement 96 includes a first plurality of inclined shelves 95 which move the initially divided liquid laterally outward, through the openings 97, over the inclined further dividing shelves 98, onto the surface 99 and through the openings 100 over and through which the cleaning liquid cascades downwardly toward outlets 102 in a progressively wider pattern. Thus, the waterfall arrangement 96 serves to evenly spread the cleaning liquid across the full width of the waterfall arrangement which delivers liquid through all of the outlets 102 and those outlets extend over the full width of the suction inlet 40 of the nozzle 12. The outlets 102 are in a row (FIG. 3) and together define the dispenser outlet with a front side 143 that is toward or closer to the rear side 142 of the suction inlet and a rear side 144 that is further away from the rear side 142 of the suction inlet.

The present invention is directed toward assuring that liquid which has been dispensed through outlets 102 across the entire width of the nozzle be delivered onto the carpet or surface being cleaned, and is not instead suctioned up before wetting that carpet or surface. Directly beneath in the drip path of liquid from the outlets 102, and slightly forward of the outlets 102 to be between the rear side 142 and the front side 143, the outlets 102 and extending laterally across the nozzle, a liquid transfer surface 110 is defined in the bottom wall 112 of nozzle. The surface 110 is preferably in the form of a continuous rib across the bottom wall 112. The rib 110 extends toward the carpet or other surface 120 being cleaned so that in the normal orientation of the unit with respect to the carpet, as shown in FIG. 2, the free edge 114 of the rib 110 contacts and presses into the carpet 120 while the outlets 102 and the front and rear sides 143 and 144 of the outlets are upraised off the carpet. Cleaning liquid, carpet shampoo, or the like exits the outlets 102, either drips straight down or migrates along the wall 112 and then along the surface or rib 110 to the carpet. The carpet fibers attract the liquid by capillary action, like a wick, and spread the cleaning solution before it is suctioned through the suction inlet 40. The edge 114 of surface or rib 110 contacts the carpet or surface 120 far enough from the inlet 40 that the carpet will receive liquid before it is suctioned. Yet, the surface or rib 110, and particularly its edge 114, is near enough to the suction inlet 40 that the cross-sectional area of the surface of the nozzle in contact with the carpet, and particularly its front to rear width, is minimized to enable the suction nozzle to press into the carpet, both under its own weight and by user pressure, to improve suctioning from the carpet pile.

Figure 5:
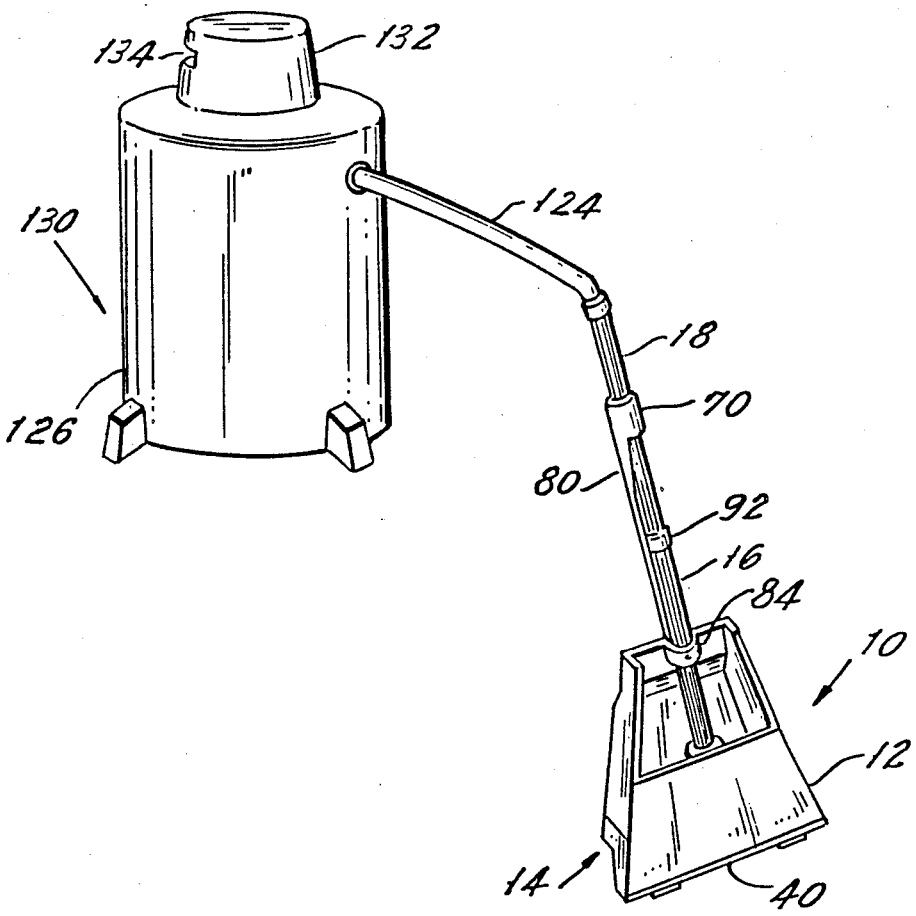
FIG. 5 shows one environment of use for the system of the invention.

After the cleaning liquid is dispensed through the openings 102 and onto the surface 120 to be cleaned, the liquid and collected dirt is then sucked through the suction inlet 40 from the surface to be cleaned. As shown in FIG. 5, the upper wand section 18, which is hand held, is connected through a flexible hose 124 into the tank 126 of a conventional wet/dry pickup, tank type electric vacuum or suction cleaner 130. A vacuum is drawn in the hose and wand section and suction nozzle 12 by a conventional blow motor 132 seated atop the tank which sucks air and liquid through the hose. The collected liquid falls into the tank 126 while the air is exhausted out of the outlet 134.

Although the invention has been described in connection with a preferred embodiment thereof, many variations and modifications may become apparent to those skilled in the art. It is preferred, therefore, that the invention be limited not by the specific disclosure herein, but only by the appended claims.

What is claimed is:

1. A liquid dispensing and suctioning system, comprising a tubular wand having a suction intake end and an exit end connectable for communicating with a suction source;

an attachment to said wand for dispensing liquid to a surface to be cleaned and for suctioning liquid from the surface, said attachment comprising:

said attachment having a bottom;

a suction nozzle having an inlet at said bottom of said attachment and positionable adjacent the surface to be cleaned for intake of liquid and having an outlet fitting attached to said intake end of said wand; said suction nozzle inlet having a first periphery including a first front side and an opposite first rear side spaced from said first front side and between them defining an inlet opening for said suction nozzle inlet, said first front and rear sides of said suction nozzle inlet extending across said attachment;

a dispenser for selectively dispensing liquid to the surface to be cleaned, said dispenser including a dispenser inlet communicating with a supply of liquid, a dispenser outlet for delivery of liquid to the surface to be cleaned and a dispenser conduit between said dispenser inlet and said dispenser outlet;

said dispenser outlet having a second periphery at said bottom of said attachment and including a second front side that is closer toward said first rear side of said suction nozzle inlet and a second rear side that is further from said suction nozzle inlet, said second front and rear sides extending across said attachment;

a liquid transmission surface at said bottom of said attachment and between said suction nozzle inlet first rear side and said dispenser outlet second front side, said transmission surface being so shaped and being of such height below said attachment, said first front and rear sides of said suction nozzle inlet being of such height below said attachment and said second front and rear sides of said dispenser outlet being of such height below said first attachment that with said liquid transmission surface disposed at the surface to be cleaned and with said first front surface of said suction nozzle disposed at the surface to be cleaned, said second front and rear surfaces of said dispenser outlet are upraised off the surface to be cleaned, whereby with said liquid transmission surface being in contact with the surface to be cleaned during dispensing of liquid by said dispenser, said liquid dispensed through said dispenser outlet travels past said liquid transmission surface for preventing direct migration of liquid from said dispenser outlet to said suction nozzle inlet without first passing around said liquid transmission surface.

2. The system of claim 1, wherein said supply of liquid comprises a tank supported at said suction nozzle for containing liquid to be dispensed; said tank being closed separate from said suction nozzle; said dispenser inlet communicating into said tank for receiving liquid therefrom;

said dispenser conduit having a flexible portion which is pinchable to cut off liquid flow between said dispenser inlet and said dispenser outlet, and said flexible portion being openable to permit flow;

an actuator movable against and away from said dispenser conduit; means for biasing said actuator toward a position to pinch said dispenser conduit for preventing liquid flow from said tank through said dispenser conduit.

3. The system of claim 2 further comprising a manually operable extension extending from said actuator up from said nozzle to a position for being graspable by a user for moving said actuator against the bias of said biasing means to an open position to open said flexible conduit to permit dispensing of liquid through said dispenser to a surface to be cleaned.

4. The system of claim 3, wherein said actuator includes a slide movable for pinching said tube and said biasing means normally urges said slide toward said pinching tube; and said extension is connected with said slide.

5. The system of claim 4 wherein said attachment includes a shelf beneath said slide for supporting said tube in position to be pinched by said slide against said shelf.

6. The system of claim 2, wherein said dispenser conduit flexible portion comprises a flexible tube, said dispenser inlet comprises said tube having a first end attached to and in communication with said tank.

7. The system of claim 6, wherein said dispenser conduit includes a second end disposed below said first end, so that liquid flows from said tank through said dispenser conduit under the force of gravity.

8. The system of claim 7, wherein said attachment includes a cross-shaped piece inserted within said second end of said dispenser conduit for maintaining said second end in an open condition and for dispensing the liquid.

9. The system of claim 8, wherein said dispenser comprises a waterfall including a plurality of walls spaced away from and below said dispenser conduit second end for further dispersing the liquid flow, and said dispenser outlet comprises a plurality of outlet openings arrayed across said dispenser.

10. The system of claim 1, wherein said dispenser comprises a waterfall including a plurality of walls spaced away from and below said dispenser conduit second end for further dispersing the liquid flow, and said dispenser outlet comprises a plurality of outlet openings arrayed across said dispenser.

11. The system of claim 1, wherein said liquid transmission surface comprises a rib at said bottom of said attachment and projecting downwardly toward the surface to be cleaned and said rib extending across said attachment and being located between said first rear surface and said second front surface; in an orientation of said attachment for said rib and said first front side to be in contact with the surface to be cleaned, said second front and rear sides are upraised off the surface to be cleaned.

* * * * *